US011329398B2

(12) United States Patent
Rojanski

(10) Patent No.: US 11,329,398 B2
(45) Date of Patent: May 10, 2022

(54) CONFORMAL ANTENNA

(71) Applicant: ISRAEL AEROSPACE INDUSTRIES LTD., Lod (IL)

(72) Inventor: Vladimir Rojanski, Petach Tikva (IL)

(73) Assignee: ISRAEL AEROSPACE INDUSTRIES LTD., Lod (IL)

( * ) Notice: Subject to any disclaimer, the term of this patent is extended or adjusted under 35 U.S.C. 154(b) by 0 days.

(21) Appl. No.: 16/620,787

(22) PCT Filed: Jun. 13, 2018

(86) PCT No.: PCT/IL2018/050647
§ 371 (c)(1),
(2) Date: Dec. 9, 2019

(87) PCT Pub. No.: WO2018/229763
PCT Pub. Date: Dec. 20, 2018

(65) Prior Publication Data

US 2020/0176889 A1 Jun. 4, 2020

(30) Foreign Application Priority Data

Jun. 13, 2017 (IL) ..... 252888

(51) Int. Cl.
*H01Q 21/20* (2006.01)
*H01Q 1/28* (2006.01)
(Continued)

(52) U.S. Cl.
CPC ..... *H01Q 21/205* (2013.01); *H01Q 1/281* (2013.01); *H01Q 1/286* (2013.01); *H01Q 3/38* (2013.01); *H01Q 21/067* (2013.01)

(58) Field of Classification Search
CPC .... H01Q 21/205; H01Q 1/281; H01Q 21/067; H01Q 3/38; H01Q 21/068; H01Q 3/36;
(Continued)

(56) References Cited

U.S. PATENT DOCUMENTS 3,110,030 A 11/1963 Cole, Jr.
3,699,574 A 10/1972 Ohara et al.
4,108,400 A 8/1978 Groutage et al.
(Continued)

FOREIGN PATENT DOCUMENTS

CN 103022726 A 4/2013
CN 103457023 A 12/2013
(Continued)

*Primary Examiner* — Vibol Tan
(74) *Attorney, Agent, or Firm* — Dorsey & Whitney LLP

(57) ABSTRACT

An antenna device is presented. The antenna device comprises: a conformal antenna body which has a desired geometry corresponding to a front portion of a platform on which the antenna device is to be mounted, and an antenna unit carried by the antenna body. The antenna unit comprises at least one phased array of antenna elements. The antenna elements of each array are arranged in a spaced-apart relationship in a closed loop path along a circumference of the antenna body having a desired geometry corresponding to a front portion of platform on which the antenna unit is to be mounted. Each of the antenna elements is configured as an end-fire antenna element capable of emitting linearly polarized radiation, the array of the antenna elements being thereby operable as a forward looking end-fire antenna array, enabling electronic steering of an antenna beam by controllably modifying phases of the antenna elements of each array.

17 Claims, 9 Drawing Sheets

(51) Int. Cl.
*H01Q 3/38* (2006.01)
*H01Q 21/06* (2006.01)

(58) Field of Classification Search
CPC ..... H01Q 21/20; H01Q 1/286; H01Q 1/28; H01Q 25/00; H01Q 1/276; H01Q 25/02; H01Q 21/24; H01Q 9/28; H01Q 1/288; H01Q 3/2658
See application file for complete search history.

(56) References Cited

U.S. PATENT DOCUMENTS 4,384,290 A 4/1983 Pierrot et al.
5,220,330 A 6/1993 Salvail et al.
5,874,915 A 2/1999 Lee et al.
6,768,456 B1 * 7/2004 Lalezari ..... G01S 13/48 342/373
6,784,838 B2 * 8/2004 Howell ..... H01Q 3/26 342/377
7,532,170 B1 * 5/2009 Lee ..... H01Q 1/281 343/705
8,594,735 B2 11/2013 Huang et al.
9,000,982 B2 * 4/2015 Chethik ..... H01Q 3/36 342/374
9,118,112 B1 8/2015 West et al.
2004/0263387 A1 12/2004 Lalezari et al.
2008/0191950 A1 8/2008 Chang et al.
2012/0181374 A1 * 7/2012 Williams ..... H01Q 1/286 244/3.19

FOREIGN PATENT DOCUMENTS

CN 106428522 A 2/2017
DE 2732627 A1 2/1979
EP 0250082 A3 3/1990

* cited by examiner

CONFORMAL ANTENNA

TECHNOLOGICAL FIELD AND BACKGROUND

The present invention is in the field of conformal antennas. Conformal antennas are designed to conform or follow a certain specific shape of a surface on which the antenna is to be mounted, typically a curved surface. Conformal antennas are used in aircrafts (civilian or military), ships, land vehicles, including also train antennas, car radio antennas, and cellular base station antennas. The use of conformal antennas in such devices provides to save space and also to make the antenna less visually intrusive by integrating it into existing objects.

Conformal antennas typically utilize a phased array of antenna elements, where each antenna element is driven by a controlled phase shifter, to provide directionality of radiation pattern of the antenna. Hence, the antenna can transmit radiation mainly in a prescribed direction (particular target zone), and be sensitive to the signal from the particular target while rejecting interfering signals from other directions. In a conformal antenna, the antenna elements are mounted on a curved surface, and therefore the phase shifters operate to compensate for the different phase shifts caused by the varying path lengths of the radiation waves due to the location of the individual antenna elements on the curved surface.

GENERAL DESCRIPTION

There is a need in the art for a novel configuration of a conformal antenna unit, which can be placed at the front end of platforms having relatively small cross sectional size (diameter), e.g. of about 3-6 wavelengths, and is capable of providing maximal performance in a generally forward-looking direction relative to the platform nose, as well as electronic steering of the antenna beam within a wide angular range, for a wide range of frequencies (e.g. 10%-30% band width with respect to the central frequency).

In this connection, it should be noted that the conventional approach of conformal antenna configuration makes it difficult, if not impossible, to use such antenna at the small-diameter front end of the platform. This difficulty is associated with a need to deal with a small-diameter conformal antenna and radome effects on the antenna beam.

A conventional conformal antenna with electronic steering property typically has an antenna boresight substantially perpendicular to the antenna surface (i.e. to the surface of the platform carrying such conformal antenna). Antenna boresight is the axis of maximum gain (maximum radiated power) of a directional antenna, and for most antennas the boresight is the axis of symmetry of the antenna. Phased array antennas can electronically steer the antenna beam, changing the angle of the boresight by shifting the relative phase of radiation emitted by different antenna elements. For conformal antennas with generally forward-looking direction, the wide angular range of antenna beam steering is required, i.e. about 70-90 degrees, which significantly affects the antenna performance. Further, conventional conformal antenna allows only partial space coverage, usually around the side of the platform on which such antenna is placed. Even if the antenna is almost spherical, different groups of antenna elements are involved for operation in different space segments. Hence, in order to increase the space coverage up to 360 degrees around the platform, two or more antenna are used each for operating in a space segment, which complicates the entire antenna system and makes it more expensive.

The present invention provides a novel conformal antenna unit, which solves that above described problem of limited operational volume (space coverage) of the conventional antennas, which is more critical for the use of antenna at the front end of the platform for generally forward-looking direction of the antenna.

The antenna unit of the invention is configured and operable as an end-fire traveling wave antenna. The antenna unit includes at least one phased array of end-fire antenna elements. The antenna elements of the array are arranged in a spaced-apart relationship along a closed-loop circumferential path conforming the circumference of the platform carrying the antenna. The antenna unit may include more than one such phased arrays arranged concentrically in a spaced-apart relationship along a longitudinal axis of the platform.

The antenna elements of the array may be equally spaced from one another along the circumferential path. Considering a substantially cylindrical or generally conical geometry of the front portion of the platform, on which the antenna is placed, the antenna array(s) are appropriately spaced from the front end (cone tip/apex). The number of the antenna elements in each array is appropriately selected in accordance with the platform diameter at the respective location and the required distance between the adjacent antenna elements in the array. Considering multiple antenna arrays spaced along the platform of the conical geometry, the number of the elements in the arrays increases with the array's distance from the cone tip.

Each of the antenna elements emits radiation of linear polarization. Phases of the antenna elements of the array are controlled in accordance with the required angular direction of the antenna beam of the entire array. For the forward direction operation of the antenna (substantially zero-steering), a phase shift, $\Delta\varphi=\varphi_i-\varphi_{i+1}$, between the phases of $i^{th}$ and $(i+1)^{th}$ neighboring antenna elements in the array of n antenna elements is determined as $\Delta\varphi=2\pi/n$. For example, for 8-element array, the phase shift between two sequential antenna elements in the direction along the circular path is 45 degrees, and for the 16-elements array, the phase shift is 22.5 degrees. For small-angle steering, i.e. up to 30 degrees of angular range of steering, phases of the antenna elements are shifted/controlled to be substantially the same for circular polarization. For relatively large-angle steering, i.e. angular range of 30 degrees or higher, the phases of all the elements in the array are controlled to be substantially the same for circular or arbitrary linear polarization.

As will be described more specifically further below, a need for such a phase shift between the successive antenna elements is associated with the fact that in the antenna configuration of the invention, each antenna element is an end-fire type antenna, namely the antenna element boresight (the axis of maximum gain of the antenna element) is substantially parallel to the surface of antenna element (rather than perpendicular to it). The polarization components of the radiation emitted by the antenna element are perpendicular to the boresight direction. Hence, in order to provide boresight of the antenna array in the desired direction while effectively utilizing the radiation emitted by all the antenna elements in the array, the above-described phase shift between the successive elements is controllably maintained.

As also will be described further below, with the above-described configuration of the phased array(s) of antenna elements, the antenna elements may be placed on/incorporated in a metallic body/surface, preferably such that the antenna array(s) is/are spaced from the front end (tip) of the platform by a metallic tip (cinder or cone, as the case may be) which actually operates as a radiating element, positively contributing to the antenna radiation pattern. The longitudinal dimension of the front end/tip portion, i.e. a distance from the tip to the antenna array ($1^{st}$ antenna array), as well as such geometrical parameters as a distance between the antenna elements in the array, and a distance between the adjacent arrays (if more than one array is used) are appropriately selected in accordance with an operational frequency band of the antenna and the geometry/dimension of the conical platform on which the antenna is to be mounted.

Thus, according to an aspect of the invention, it provides an antenna device comprising: a conformal antenna body which has a desired geometry corresponding to a front portion of a platform on which the antenna device is to be mounted, and an antenna unit carried by the antenna body, the antenna unit comprising at least one phased array of antenna elements, the antenna elements of each array being arranged in a spaced-apart relationship in a closed loop path along a circumference of the antenna body having a desired geometry corresponding to a front portion of platform on which the antenna unit is to be mounted, each of the antenna elements is configured as an end-fire antenna element capable of emitting linearly polarized radiation, the array of the antenna elements being thereby operable as a forward looking end-fire antenna array, enabling electronic steering of an antenna beam by controllably modifying phases of the antenna elements of each array.

The antenna body may be of a substantially cylindrical shape or substantially conical shape or substantially spherical shape. The antenna unit is spaced a predetermined distance from a base region of the cylindrical antenna body or apex region of the conical antenna body. The antenna body may be made of a metallic material.

It should be noted that, although in the description below the "closed-loop path" is at times referred to as a "circular path", the invention is not limited to a circular cross section of the antenna body, and this expression should therefore be interpreted broadly, covering any curved-surface geometry of the antenna body, e.g. circular, oval-like, polygonal, as well as geometry of varying cross-sectional shape and/or dimension.

The antenna elements in the antenna array may be equally spaced from one another along the closed loop path. The antenna unit may comprise two or more antenna arrays arranged in a spaced-apart relationship along the antenna body. The different antenna arrays may include the same number of antenna elements; or may include arrays having different number of antenna elements.

The antenna device further includes a phase controller circuit for controlling phases of all the antenna elements in each antenna array to provide a desired boresight of the antenna array in accordance with a selected radiation direction. The phase controller is configured and operable for providing a predetermined phase pattern of the antenna array resulting in a circular polarization of the antenna radiation of said antenna elements. Such phase pattern may be such that the phases of the antenna elements in the array are shifted one with respect to the other along a circular direction, such that each successive antenna element in said direction has a phase shifted by a predetermined value with respect to a preceding antenna element.

BRIEF DESCRIPTION OF THE DRAWINGS

In order to better understand the subject matter that is disclosed herein and to exemplify how it may be carried out in practice, embodiments will now be described, by way of non-limiting example only, with reference to the accompanying drawings, in which.

DETAILED DESCRIPTION OF EMBODIMENTS

Figure 1A:
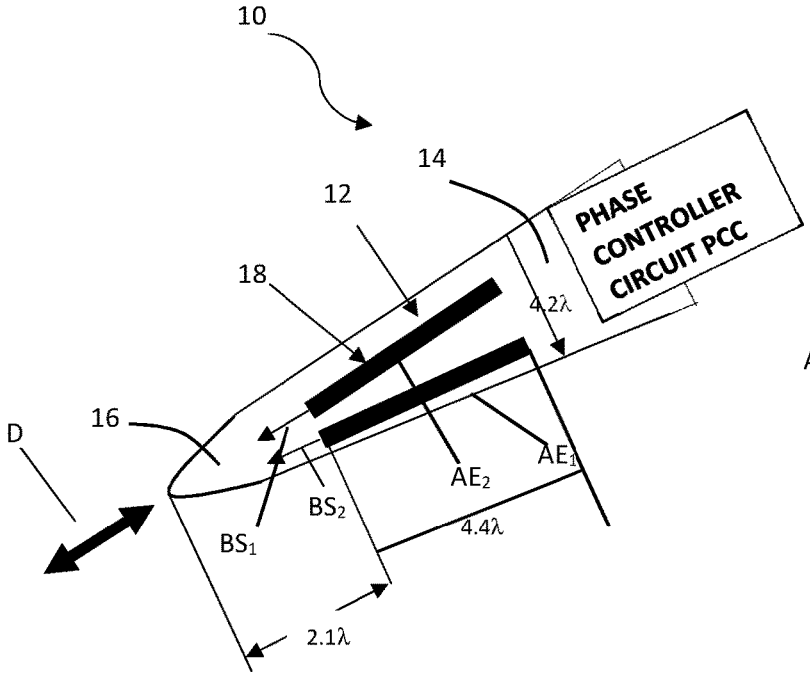
FIGS. 1A and 1B schematically illustrate an example of an antenna device of the present invention.
Figure 1B:
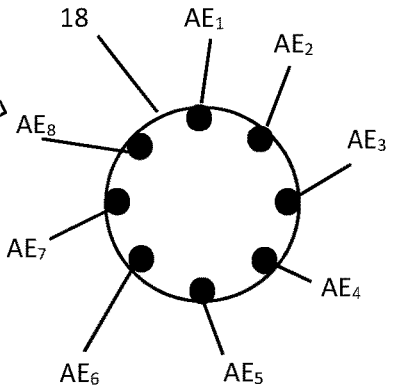
Figure 2:
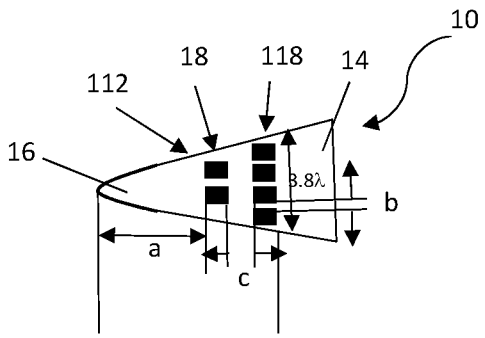
FIG. 2 is a schematic illustration of another possible example of an antenna device of the present invention.

Reference is made to FIGS. 1A-1B and 2 shown two specific but not limiting examples of an antenna device of the present invention utilizing two different configurations of the antenna unit. To facilitate illustration and understanding, the same reference numbers are used to indicate components that are common in all the examples of the invention.

In both examples, the antenna device 10 includes a conformal antenna unit mounted on a supporting antenna body 14 having a curved surface corresponding to that of a platform on which the antenna device is to be mounted. In these examples, the antenna body 14 has a substantially conical geometry. It should, however, be understood that the invention is not limited to any specific geometry of the curved surface carrying the antenna unit, in which antenna elements are arranged in one or more circular antenna arrays, i.e. antenna elements are arranged in a spaced apart relationship along one or more closed-loop paths. FIG. 1A also includes a phase controller circuit PCC for controlling phases of all the antenna elements in each antenna array to provide a desired boresight of the antenna array in accordance with a selected radiation direction.

The antenna device of the invention is particularly useful for placing on a front portion of a platform and is configured and operable for operating in a so-called "forward-looking mode", namely having a general forward-looking radiation direction D with an ability to be electronically steered within a wide angular range around this general radiation direction. In the example of FIGS. 1A-1B the antenna unit 12 includes one phased array 18, and in the example of FIG. 2 the antenna unit 112 includes two phased arrays 18 and 118.

It should be noted that the principles of the invention are not limited to a number of phased arrays of antenna elements, as well as are not limited to number(s) of the antenna elements in the array(s). Thus, generally, the antenna unit 12 may include m antenna arrays, $m \geq 1$, such that multiple antenna arrays are located in a spaced-apart relationship along the longitudinal axis of the body 14, and each of the antenna arrays includes multiple antenna elements located in a spaced-apart relationship along a circumferential path. In these specific examples, where the antenna body 14 has a conical geometry, the number of the elements in the arrays increases with the array's distance from a cone tip/apex 16. For example, the antenna array 18 (which is the single array in the example of FIGS. 1A-1B, and is the first array located closer to the tip portion 16 in the example of FIG. 2) has eight antenna elements $AE_1$-$AE_8$, and in the second antenna array 118 in the example of FIG. 2, located farer from the tip portion 16 includes sixteen antenna elements.

The antenna elements of the same array are preferably equally spaced from one another. In case more than one antenna arrays are used, the distance between the antenna elements of one array may or may not be equal to the distance of the antenna elements in one or more other arrays. The number(s) of the antenna elements in the array(s) is/are selected in accordance with the dimensions and shape of the antenna body, i.e. of the platform, and frequency and gain requirements for the antenna operation. The antenna body may be a metallic body. The metallic tip portion 16 of the body contributes to the antenna radiation pattern. Such parameters as the longitudinal dimension a of the tip portion 16 (i.e. a distance of the antenna array from the tip of the antenna body), as well as a distance b between the antenna elements in the array, and possibly also a distance c between the antenna arrays, are selected/optimized in accordance with the frequency and gain requirements for the antenna operation. For example, when higher operational frequencies are to be used, the distance a may be lower than that preferred for lower operational frequencies of the antenna device.

Figure 3:
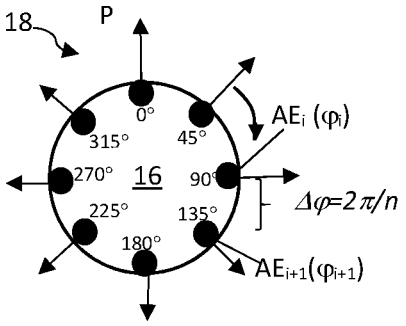
FIG. 3 schematically illustrates the principles of a phase shift technique utilized in the present invention for the antenna operation in forward-looking direction.

Each antenna element AE is an end-fire antenna element, whose boresight BS (shown in FIG. 1A), being the axis of maximum gain of the antenna element, is substantially parallel to the surface of the antenna element. Reference is now made to FIG. 3 schematically illustrating the structural and operational principles of the antenna array, e.g. array 18, for the forward-looking direction in the antenna unit of the invention. As known, the polarization components P of the radiation emitted by the antenna element are perpendicular to the boresight direction of the antenna element. Hence, in order to provide desired orientation of the boresight of the antenna array 18 (to provide desired directional operation of the antenna), while effectively utilizing the radiation emitted by all the antenna elements in the array (i.e. maximizing the performance) for each required direction, the phases of the antenna elements in the array are appropriately controlled.

It should be understood, although not specifically illustrated, that the antenna device includes suitable phase shifters/controllers, and is associated with a control unit configured and operable to analyze input data about the operational direction and generate corresponding phase control data with respect to each antenna element in each array. The phase shifters utilize this control data to adjust the phases for the antenna elements. If the antenna operation with relatively small-angle steering, angular range of up to 30 degrees, is needed, the phases of all the elements in the array are controlled to be substantially the same for each direction within this angular range for circular polarization of the beam. For the antenna operation with relatively wide-angle steering, i.e. angular range of 30 degrees or higher, the phases of all the elements in the array are controlled to be substantially the same for each direction in this angular range for circular or arbitrary linear polarization of the beam.

For substantially forward direction D, zero-steering from this direction, a phase, $\varphi_{i+1}$, of each successive antenna element $AE_{i+1}$ is shifted from the phase, $\varphi_I$, of the preceding antenna element $AE_i$ in a direction along the circular path (as shown in FIG. 3) by the same value of the phase shift, $\Delta\varphi=\varphi_i-\varphi_{i+1}$, such that the antenna beam of the entire array 18 is of circular polarization. A phase shift $\Delta\varphi$ between the phases of each two neighboring elements, considered as the successive elements in the direction along the circular path, in the array of n antenna elements is determined as $\Delta\varphi=2\pi/n$. For example, for 8-element array 18, the phase shift $\Delta\varphi$ is 45 degrees, and for the 16-elements array 118, the phase shift is 22.5 degrees.

Reference is made to FIGS. 4A-4E and FIGS. 5A-5D illustrating simulation results for the performance of the antenna device according to the invention. Here, FIGS. 4A-4B and 4C-4E correspond to the antenna device utilizing an antenna unit configuration of FIG. 1; and FIGS. 5A-5B and 5C-5D correspond to the antenna device utilizing an antenna unit configuration of FIG. 2.

More specifically, the simulation results illustrated in FIGS. 4A-4E correspond to the antenna unit configuration of FIG. 1 with the following parameters: the platform diameter of 4.2λ, the antenna element length and width of 4.4λ and 0.5λ respectively, and the distance a between the end of the of platform and the antenna unit (first array) of 2.1λ. The simulation illustrated in FIGS. 5A-5D correspond to the antenna unit configuration of FIG. 2 with the following parameters: the platform diameter of 3.8λ, the antenna element length and width of 1.2λ and 0.5λ respectively, the distance a between the end of the of platform and the antenna unit (first array) of 2.1λ, and the distance c between the first and second antenna arrays of 1.4λ.

Figure 4A:
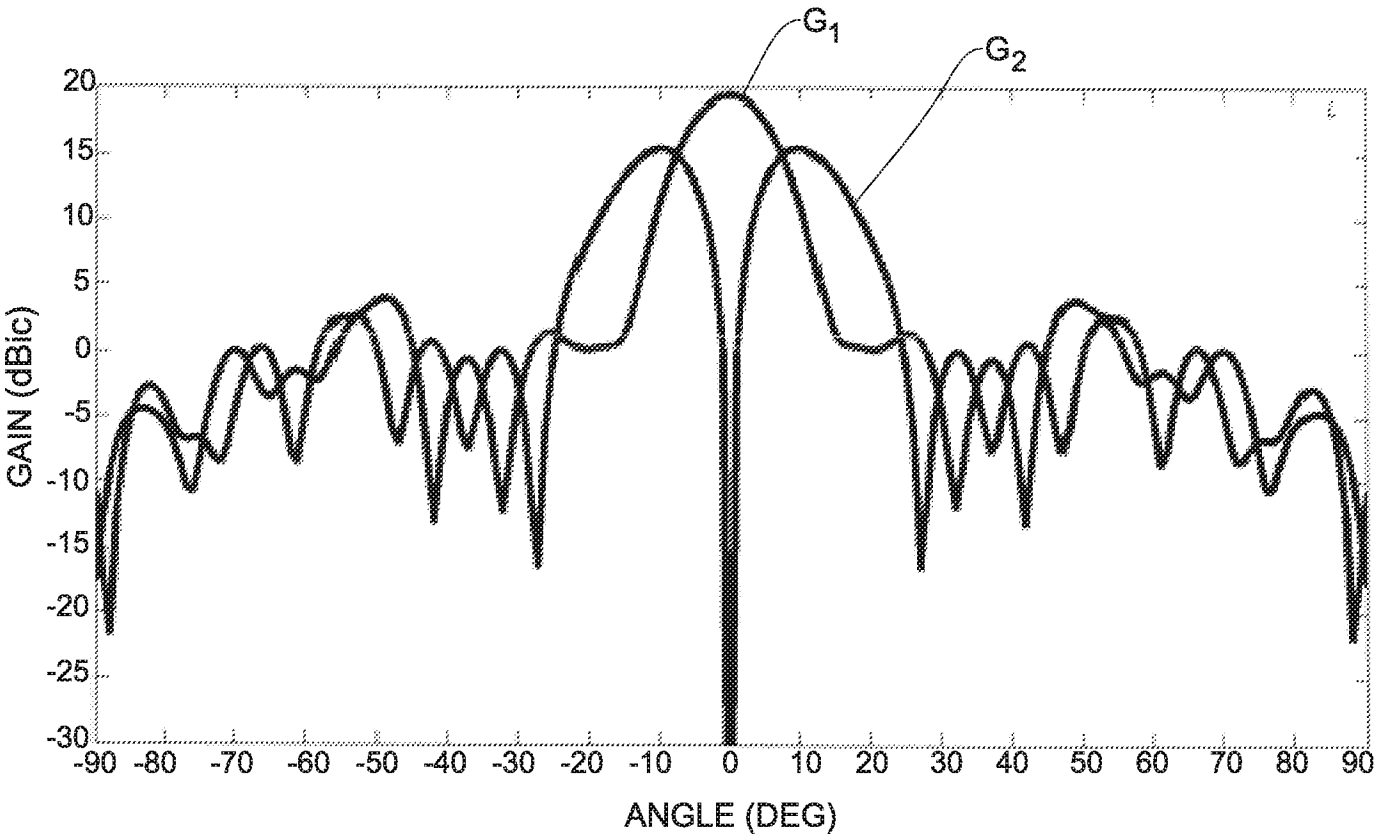
FIGS. 4A-4B and 4C-4E exemplify simulation results for the performance of the antenna device of the invention utilizing an antenna unit configuration of FIG. 1, for respectively zero-degree and 10 degree angular orientations of the antenna boresight.
Figure 4B:
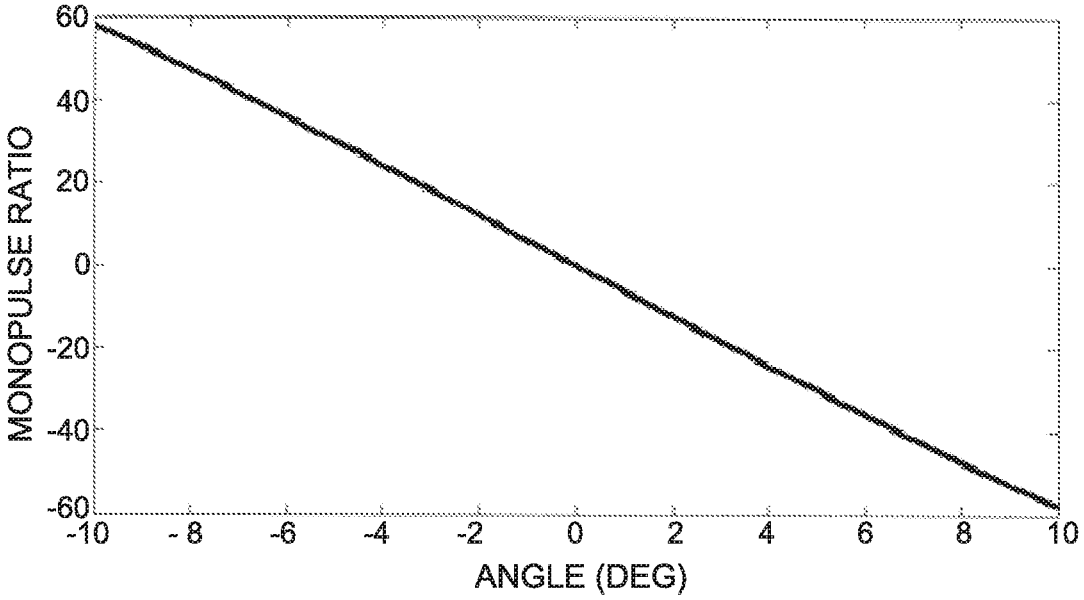

FIG. 4A exemplifies simulation of the antenna unit operation (in a receiving mode), and shows the sum signal pattern versus azimuth angle of a target (graph $G_1$) and the azimuth difference signal pattern versus azimuth angle of a target (graph $G_2$), in the azimuth plane, when the boresight angle is substantially zero, the antenna received signals have circular polarization. It should be understood that for the antenna operation in a transmitting mode, there is no such azimuth difference signal pattern vs azimuth angle, while the sum signal pattern vs azimuth angle is substantially the same as for the receiving mode operation. FIG. 4B illustrates the dependencies of the monopulse ratio on the azimuth angle obtained for the transceiver elements (antenna elements) of the array that receive signals having circular polarization, when the antenna boresight angle is zero degrees.

Figure 4C:
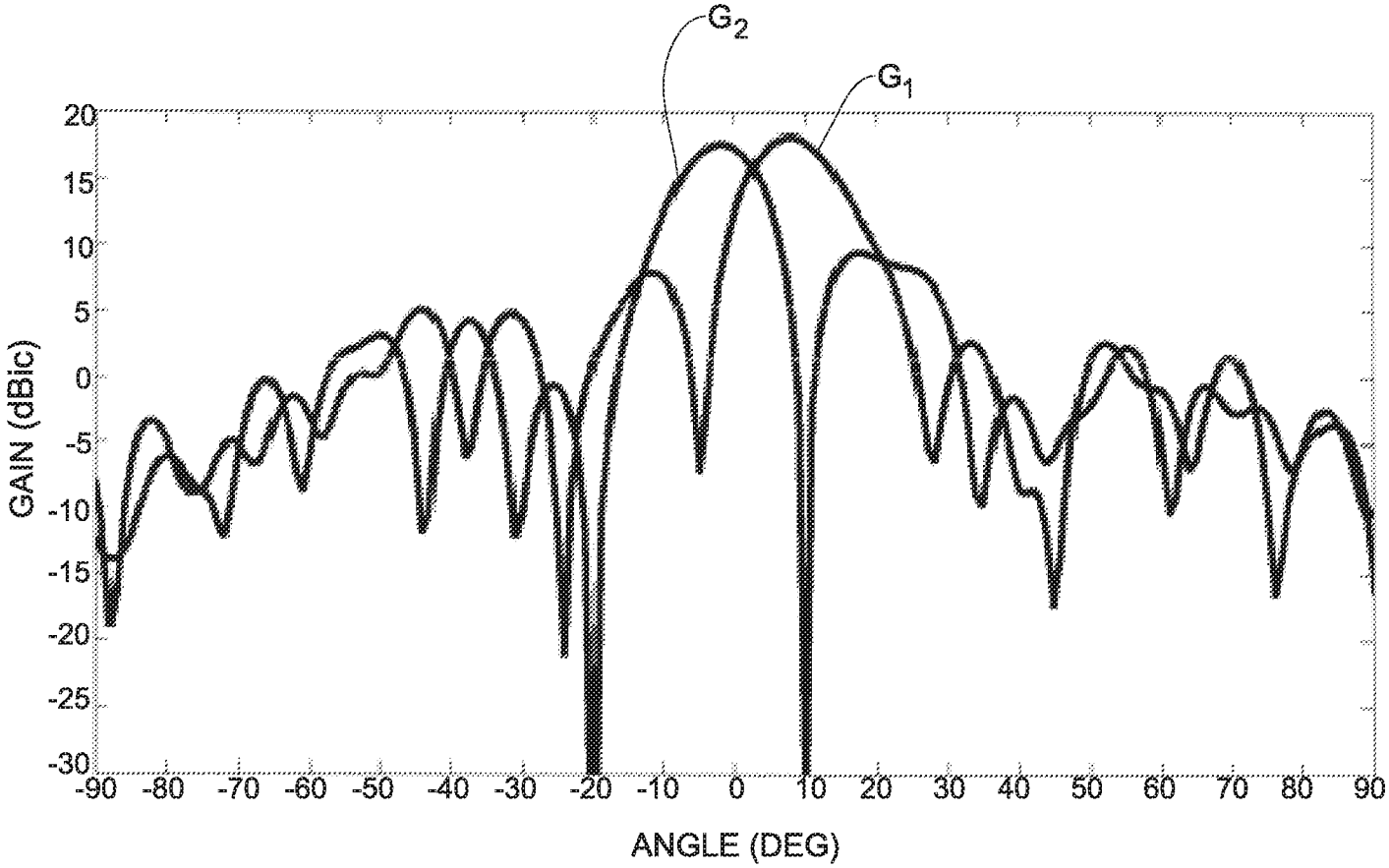
Figure 4D:
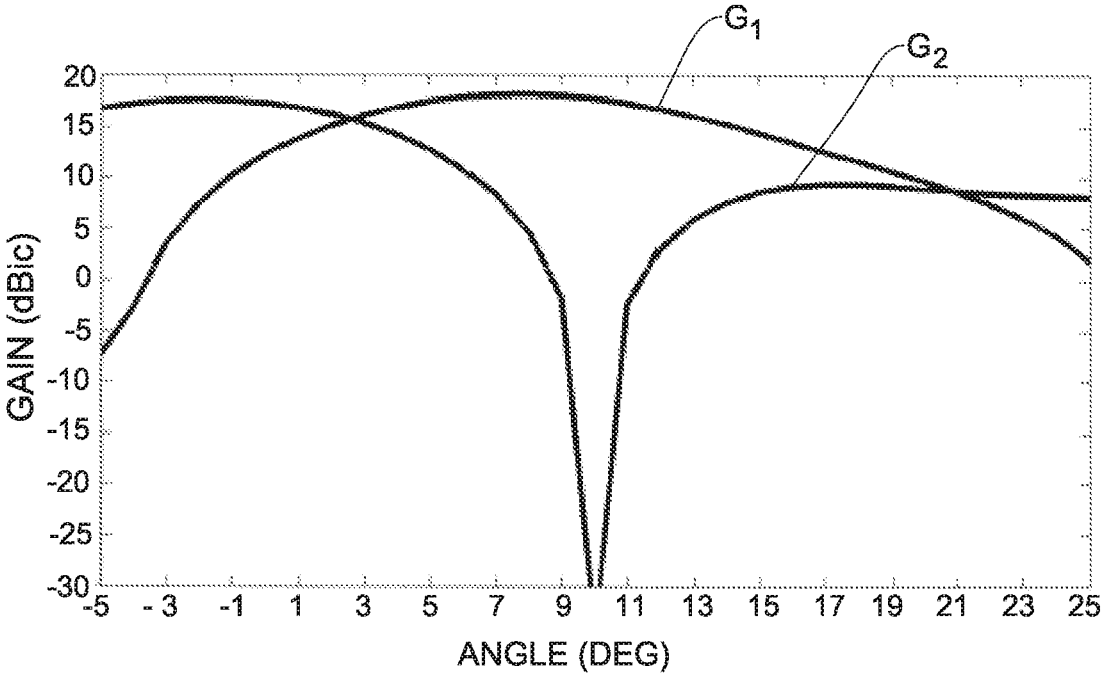
Figure 4E:
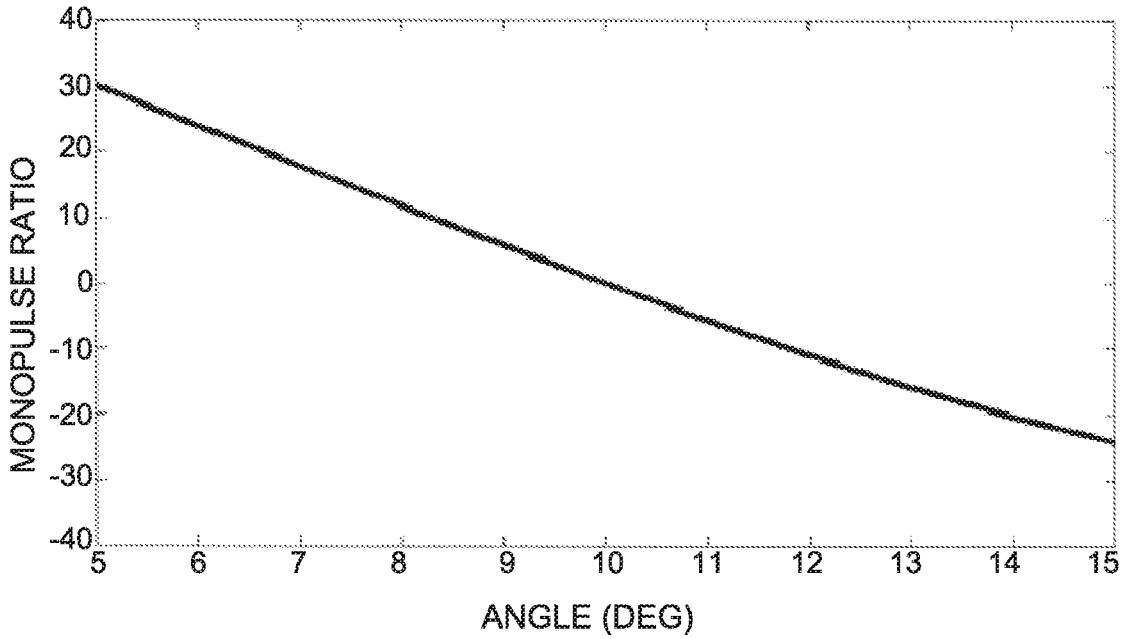

FIG. 4C exemplify simulation for the sum signal pattern (graph $G_1$) and the azimuth difference signal pattern (graph $G_2$) in the azimuth plane versus azimuth angle of a target, when the boresight angle is 10 degrees and the received signal have circular polarization. FIG. 4D is a zoom on the specific angular segment of the graphs in FIG. 4C. FIG. 4E shows dependencies of the monopulse ratio on the azimuth angle obtained for the transceiver elements of the array that receive signals having circular polarization, when the antenna boresight angle is at 10 degrees orientation.

Figure 5A:
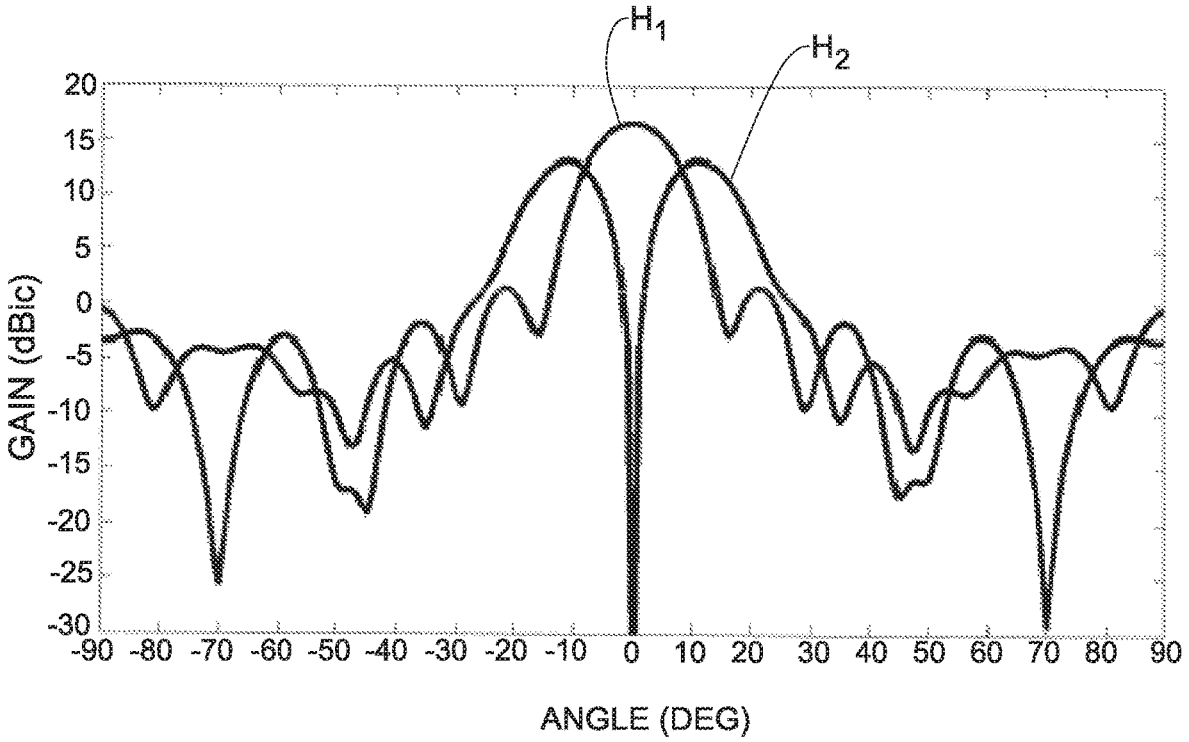
FIGS. 5A-5D exemplify simulation results for the performance of the antenna device of the invention utilizing an antenna unit configuration of FIG. 2 for zero-degree orientation of the antenna boresight.
Figure 5B:
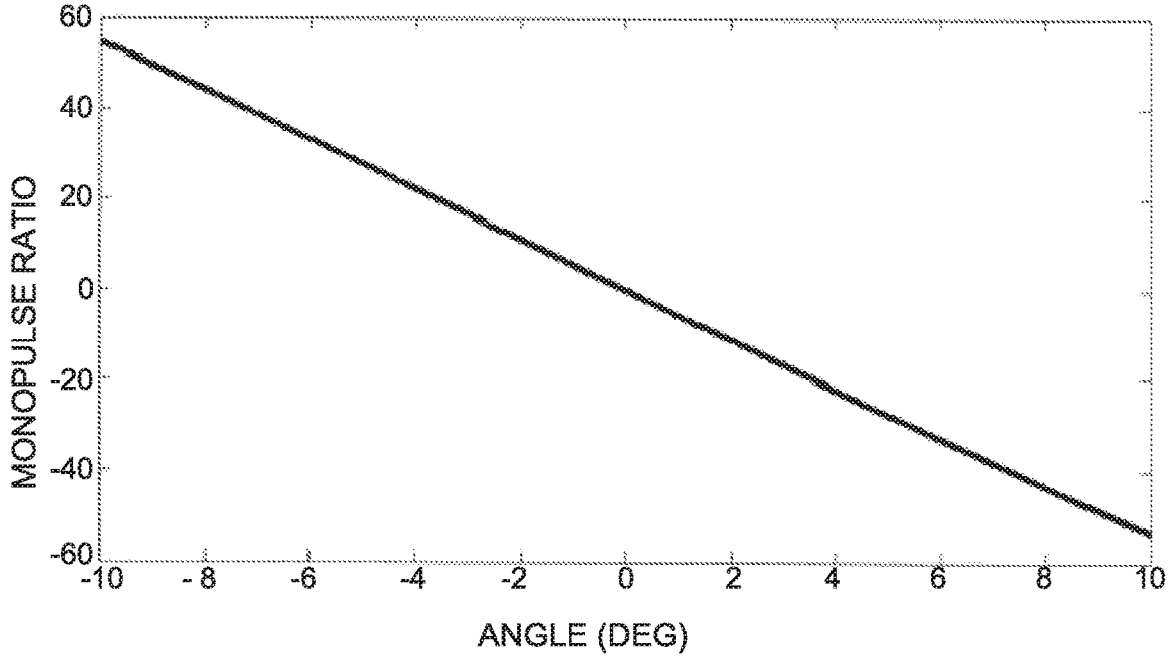
Figure 5C:
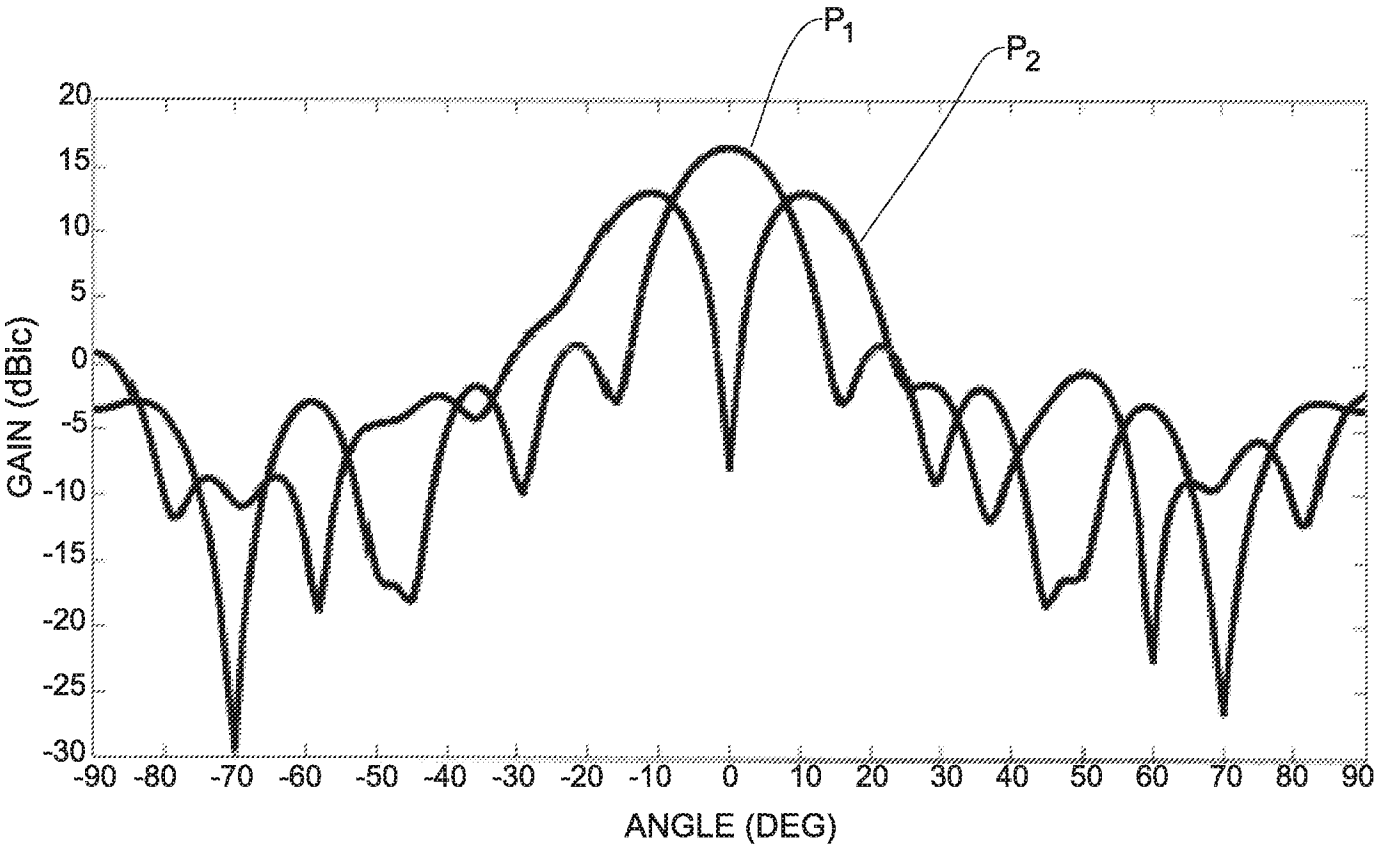
Figure 5D:
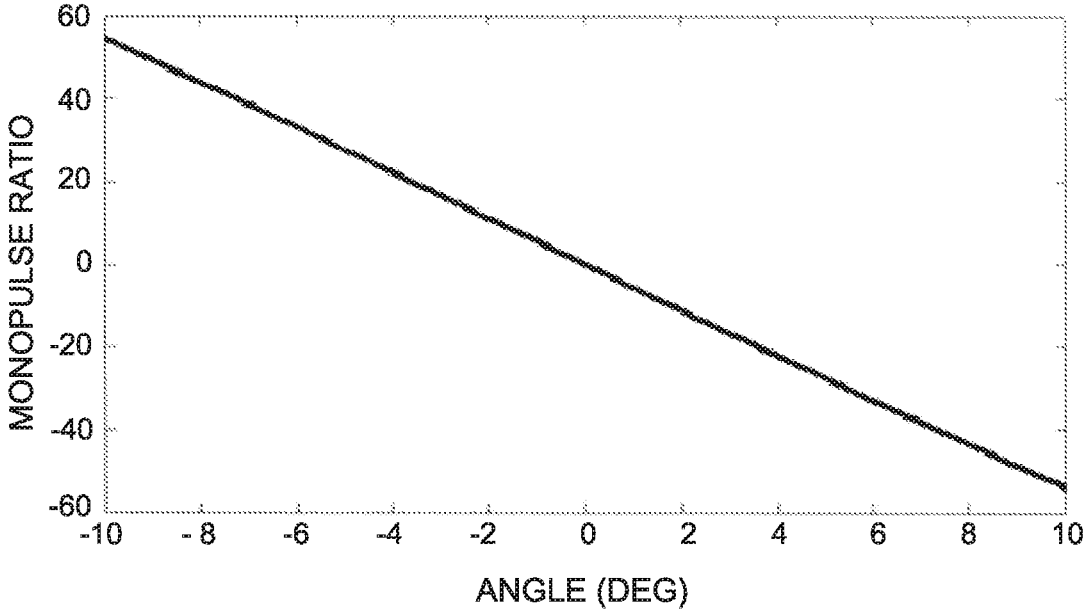

FIGS. 5A and 5B show the sum signal pattern (graph $H_1$) and the azimuth difference signal pattern (graph $H_2$) in the azimuth plane versus azimuth angle of a target (FIG. 5A), and the dependencies of the monopulse ratio on the azimuth angle (FIG. 5B), for the circular polarization and the zero angle of boresight orientation. FIGS. 5C and 5D show similar results in the elevation plane, for the circular polarization and the zero angle of boresight orientation: FIG. 5C shows the sum signal pattern in the elevation plane versus elevation angle of a target (graph $P_1$), and the elevation difference signal pattern in the elevation plane versus elevation angle of a target (graph $P_2$), and FIG. 5D shows the dependencies of the monopulse ratio on the elevation angle.

Thus, by using the above described configuration and operation of the antenna unit, all the antenna elements, as well as the radiating portion 16 of the antenna body, positively contribute to the antenna pattern in each selected radiation direction within the wide angular range of steering. The present invention advantageously provides for maximizing the performance of the conformal antenna for the forward-looking operation, with the electronic steering within the wide angular range (i.e. such that all the antenna elements contribute in the antenna pattern for each angular direction), for a wide frequency band. The antenna device can operate in high-temperature environmental conditions. The antenna can be incorporated in a metallic body. The antenna device of the present invention can be mounted on a small-diameter platform body. The antenna device of the invention may be used without a radome, which significantly simplifies the device configuration. The conformal antenna device of the present invention can be used in any communication and telemetric application, being mounted on a suitable platform.

The invention claimed is:

1. An antenna device, comprising:

a conformal antenna body which has a desired geometry corresponding to a front portion of a platform on which the antenna device is to be mounted;

an antenna unit carried by the antenna body, the antenna unit comprising at least one phased array of antenna elements, the antenna elements of each phased array being arranged in a spaced-apart relationship in a closed loop path along a circumference of the antenna body having a desired geometry corresponding to a front portion of platform on which the antenna unit is to be mounted, each of the antenna elements is configured as an end-fire antenna element capable of emitting linearly polarized radiation, the array of the antenna elements being thereby operable as a forward looking end-fire antenna array; and a phase controller circuit configured and operable to control phases of all the antenna elements in each antenna array to provide a desired boresight of the antenna array in accordance with a selected radiation direction, thereby enabling electronic steering of an antenna beam produced by all the antenna elements of said at least one phased array by controllably modifying phases of the antenna elements of said at least one phased array.

2. The antenna device according to claim 1, wherein the antenna body has a substantially cylindrical shape, and the antenna unit is spaced a predetermined distance from a base region of the cylindrical antenna body.

3. The antenna device according to claim 1, wherein the antenna body has a substantially conical shape, and the antenna unit is spaced a predetermined distance from an apex region of the antenna body.

4. The antenna device according to claim 1, wherein the antenna body is configured as at least a part of a substantially spherical shape.

5. The antenna device according to claim 1, wherein the antenna body is made of a metallic material.

6. The antenna device according to claim 1, wherein the antenna elements in the antenna array are equally spaced from one another along said closed loop path.

7. The antenna device according to claim 1, wherein the antenna unit comprises two or more of the antenna arrays arranged in a spaced-apart relationship along the antenna body.

8. The antenna device according to claim 7, wherein the different antenna arrays have the same number of antenna elements.

9. The antenna device according to claim 7, wherein the antenna arrays comprise arrays having different number of antenna elements.

10. The antenna device according to claim 1, wherein the phase controller is configured and operable for providing a predetermined phase pattern of the antenna array resulting in a circular polarization of the antenna radiation of said antenna elements.

11. The antenna device according to claim 1, wherein the phase controller is configured and operable to control the phases of all the antenna elements in the antenna array such that the phases of the antenna elements in the array are shifted one with respect to the other along a circular direction, and each successive antenna element in said direction has a phase shifted by a predetermined value with respect to a preceding antenna element.

12. The antenna device according to claim 11, wherein the phase shift $\Delta\varphi$ between each two successive antenna elements is determined as $\Delta\varphi=2\pi/n$ for the antenna array of n elements.

13. The antenna device according to claim 11, wherein said phase pattern corresponds to the antenna unit operation in a forward-looking direction.

14. The antenna device according to claim 1, wherein the phase controller is configured and operable to control the phases of all the antenna elements to be substantially the same, for each radiation direction in an angular range of up to 30 degrees of radiation directions.

15. The antenna device according to claim 1, wherein the phase controller is configured and operable to control the phases of all the antenna elements to be substantially the same, for each radiation direction in an angular range of 30 degrees or higher, for circular or arbitrary linear polarization of the antenna radiation.

16. An antenna device, comprising:

a conformal antenna body which has a desired geometry corresponding to a front portion of a platform on which the antenna device is to be mounted;

an antenna unit carried by the antenna body, the antenna unit comprising at least one phased array of antenna elements, the antenna elements of each array being arranged in a spaced-apart relationship in a closed loop path along a circumference of the antenna body having a desired geometry corresponding to a front portion of platform on which the antenna unit is to be mounted, each of the antenna elements is configured as an end-fire antenna element capable of emitting linearly polarized radiation, the array of the antenna elements being thereby operable as a forward looking end-fire antenna array; and a phase controller circuit configured and operable to control phases of all of the antenna elements in the antenna array providing a predetermined phase pattern of the antenna array resulting in a circular polarization of the antenna radiation of said antenna elements of said array, to provide a desired boresight of the antenna array in accordance with a selected radiation direction, thereby enabling electronic steering of an antenna beam by controllably modifying phases of the antenna elements of the array.

17. An antenna device, comprising:

a conformal antenna body which has a desired geometry corresponding to a front portion of a platform on which the antenna device is to be mounted;

an antenna unit carried by the antenna body, the antenna unit comprising at least one phased array of antenna elements, the antenna elements of said at least one phased array being arranged in a spaced-apart relationship in a closed loop path along a circumference of the antenna body having a desired geometry corresponding to a front portion of platform on which the antenna unit is to be mounted, each of the antenna elements is configured as an end-fire antenna element capable of emitting linearly polarized radiation, the array of the antenna elements being thereby operable as a forward looking end-fire antenna array; and a phase controller circuit configured and operable to control phases of all the antenna elements in each antenna array to provide a desired boresight of the phased array in accordance with a selected radiation direction, thereby enabling electronic steering of an antenna beam produced by all the antenna elements of said at least one phased array by controllably modifying phases of the antenna elements of said at least one phased array;

wherein the phase controller is configured and operable to control the phases of all the antenna elements to be substantially the same, for each radiation direction in an angular range of up to 30 degrees of radiation directions.

* * * * *